US011517073B2

(12) United States Patent
Hernandez Garcilazo et al.

(10) Patent No.: US 11,517,073 B2
(45) Date of Patent: Dec. 6, 2022

(54) ARTICLE OF FOOTWEAR WITH MIDFOOT FLEXIBILITY

(71) Applicant: NIKE, Inc., Beaverton, OR (US)

(72) Inventors: Rolando Hernandez Garcilazo, Portland, OR (US); Jeffrey S. To, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 44 days.

(21) Appl. No.: 16/804,044

(22) Filed: Feb. 28, 2020

(65) Prior Publication Data

US 2020/0275736 A1 Sep. 3, 2020

Related U.S. Application Data

(60) Provisional application No. 62/812,500, filed on Mar. 1, 2019.

(51) Int. Cl.
*A43B 13/14* (2006.01)
*A43B 13/16* (2006.01)
*A43B 13/18* (2006.01)

(52) U.S. Cl.
CPC ..... *A43B 13/141* (2013.01); *A43B 13/16* (2013.01); *A43B 13/187* (2013.01)

(58) Field of Classification Search
CPC ..... A43B 13/141; A43B 13/16; A43B 13/187; A43B 13/181; A43B 13/12; A43B 13/122; A43B 13/125; A43B 3/0068; A43B 3/0036; A43B 13/143; A43B 13/145; A43B 13/146
USPC ..... 36/102, 103; D2/908, 947
See application file for complete search history.

(56) References Cited

U.S. PATENT DOCUMENTS

| | | | | |
|---|---|---|---|---|
| 5,077,916 | A * | 1/1992 | Beneteau | B29D 35/061 36/31 |
| 8,959,802 | B2 | 2/2015 | Hatfield et al. | |
| 9,833,039 | B2 | 12/2017 | Smaldone et al. | |
| D812,882 | S * | 3/2018 | Jenkins | D2/947 |
| 10,537,151 | B2 | 1/2020 | Kohatsu et al. | |

(Continued)

FOREIGN PATENT DOCUMENTS

| | | |
|---|---|---|
| CN | 101188955 A | 5/2008 |
| CN | 105831875 A | 8/2016 |

(Continued)

*Primary Examiner* — Jameson D Collier
*Assistant Examiner* — Matthew R Marchewka
(74) *Attorney, Agent, or Firm* — Quinn IP Law

(57) ABSTRACT

A sole structure for an article of footwear includes a connecting portion coupled to a siped portion. The connecting portion extends across the sole structure, with an upper surface operative to be secured to an upper of the article of footwear. The siped portion extends from a ground-facing side of the connecting portion and includes a plurality of sole elements. Each of the plurality of sole elements is at least partially defined by one or more of a plurality of sipes that extend from the ground-contacting surface to the ground-facing side of the connecting portion. At least one of the plurality of sipes is a lateral sipe that is located within the midfoot region and extends from the medial side to the lateral side of the sole structure. This at least one lateral sipe is sized to permit plantarflexion of the sole structure without deformation of an adjacent sole element.

13 Claims, 6 Drawing Sheets

(56) References Cited

U.S. PATENT DOCUMENTS

2002/0017038 A1* 2/2002 Umezawa ..... A43B 13/02 36/31
2005/0076536 A1* 4/2005 Hatfield ..... A43B 7/06 36/3 B
2006/0096124 A1* 5/2006 Moseley ..... A43B 3/128 36/11.5
2007/0209230 A1* 9/2007 Dillon ..... A43B 13/183 36/25 R
2008/0229617 A1* 9/2008 Johnson ..... A43B 3/0057 36/102
2011/0185590 A1* 8/2011 Nishiwaki ..... A43B 13/181 36/28
2012/0233885 A1 9/2012 Shaffer et al.
2013/0000152 A1* 1/2013 Cooper ..... A43B 13/141 36/102
2014/0013624 A1* 1/2014 Stockbridge ..... A43B 13/181 36/103
2014/0101972 A1* 4/2014 Ha ..... A43B 13/181 36/102
2014/0259744 A1* 9/2014 Cooper ..... A43B 13/122 36/28
2014/0283413 A1* 9/2014 Christensen ..... A43B 3/0057 36/102
2015/0250260 A1* 9/2015 Bessho ..... A43B 7/18 36/25 R
2017/0273401 A1 9/2017 Hatfield et al.
2018/0110287 A1* 4/2018 Hopkins ..... A43B 3/248
2019/0053571 A1* 2/2019 Bjornson ..... A43B 7/1445

FOREIGN PATENT DOCUMENTS

EP 2753206 A1 7/2014
EP 2764788 A1 8/2014
TW 201927185 A 7/2019
WO 2008115743 A1 9/2008
WO 2016196770 A1 12/2016

* cited by examiner

ARTICLE OF FOOTWEAR WITH MIDFOOT FLEXIBILITY

CROSS REFERENCE TO RELATED APPLICATIONS

The present application claims the benefit of priority from U.S. Provisional Patent Application No. 62/812,500, filed 1 Mar. 2019, which is incorporated by reference in its entirety.

TECHNICAL FIELD

The present disclosure relates to an article of footwear with enhanced flexibility to plantarflexion within the midfoot region.

BACKGROUND

Conventional articles of athletic footwear include two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and is generally positioned between the foot and the ground. In addition to attenuating ground reaction forces and absorbing energy (i.e., imparting cushioning), the sole structure may provide traction and control potentially harmful foot motion, such as over pronation. Accordingly, the upper and the sole structure operate cooperatively to provide a comfortable structure that is suited for a wide variety of ambulatory activities, such as walking and running.

The sole structure generally incorporates multiple layers that are conventionally referred to as an insole, a midsole, and an outsole. The insole is a thin, cushioning member located within the upper and adjacent the plantar (lower) surface of the foot to enhance footwear comfort. The midsole, which is traditionally attached to the upper along the entire length of the upper, forms the middle layer of the sole structure and serves a variety of purposes that include controlling foot motions and providing cushioning. The outsole forms the ground-contacting element of footwear and is usually fashioned from a durable, wear-resistant material that includes texturing to improve traction.

The primary element of a conventional midsole is a resilient, polymer foam material, such as polyurethane or ethylvinylacetate, that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness, degree of ground reaction force attenuation, and energy absorption properties may be altered to meet the specific demands of the activity for which the footwear is intended to be used.

SUMMARY

The present disclosure relates to an article of footwear and sole structure for an article of footwear that is specially designed to promote and/or permit short-footing (also known as plantarflexion). Short-footing is the foot motion where the balls of the foot are drawn back toward the heel to exaggerate the arch of the foot. It is the opposite of dorsiflexion which is the typical running motion where the heel pivots upward relative to a planted forefoot.

In some embodiments, the article of footwear may include a sole structure that has a connecting portion coupled to a siped portion. The connecting portion comprises an upper surface and an opposite ground-facing side, and the siped portion comprises an upper side and an opposite ground-contacting surface. The connecting portion extends across the sole structure and the upper surface is operative to be secured to the upper.

The siped portion extends from the ground-facing side of the connecting portion and includes a plurality of sole elements. Each of the plurality of sole elements is at least partially defined by one or more of a plurality of sipes that extend from the ground-contacting surface to the ground-facing side of the connecting portion. At least one of the plurality of sipes is a lateral sipe that is located within the midfoot region and extends from the medial side to the lateral side of the sole structure. This lateral sipe is sized to permit plantarflexion of the sole structure with little or no deformation of an adjacent sole element. In some embodiments, the sipe may define a prism-shaped void, with a transverse width of, for example, between about 3 mm and about 8 mm.

DETAILED DESCRIPTION

The following discussion and accompanying figures disclose an article of footwear 10 in accordance with the present invention. Footwear 10 is depicted in the figures and discussed below as having a configuration that is suitable for athletic activities, particularly running. The concepts disclosed with respect to footwear 10 may, however, be applied to footwear styles that are specifically designed for a wide range of other athletic activities, including basketball, baseball, football, soccer, walking, and hiking, for example, and may also be applied to various non-athletic footwear styles. Accordingly, one skilled in the relevant art will recognize that the concepts disclosed herein may be applied to a wide range of footwear styles and are not limited to the specific embodiments discussed below and depicted in the figures.

Footwear 10 is depicted in FIGS. 1-3B and includes an upper 20 and a sole structure 30. Upper 20 is formed from various material elements that are stitched or adhesively-bonded together to form an interior void that comfortably receives a foot and secures the position of the foot relative to sole structure 30. Sole structure 30 is secured to a lower portion of upper 20 and provides a durable, wear-resistant component for attenuating ground reaction forces and absorbing energy (i.e., providing cushioning) as footwear 10 impacts the ground.

Many conventional articles of footwear exhibit a configuration that controls the motion of the foot during running or other activities. A conventional sole structure, for example, may have a relatively stiff or inflexible construction that inhibits the natural motion of the foot. In the present design, the sole structure 30 has a structure that can articulate, flex, stretch, or otherwise move to provide an individual with a sensation of natural, barefoot running. That is, the sole structure 30 is configured to complement the natural motion of the foot during running or other activities. In contrast with barefoot running, however, sole structure 30 attenuates ground reaction forces and absorbs energy to cushion the foot and decrease the overall stress upon the foot.

In addition to simply providing for natural foot dorsiflexion during a typical running stride, the present designs may further permit the wearer to perform or engage in various plantar flexion or short-foot motions that draw the metatarsal heads (balls of the toes) toward the heel while increasing the longitudinal arch. In doing so, the present shoe may be less constrained than conventional shoes, and have a sole that can more easily articulate with the full range of the wearer's natural foot motions.

Figure 1:
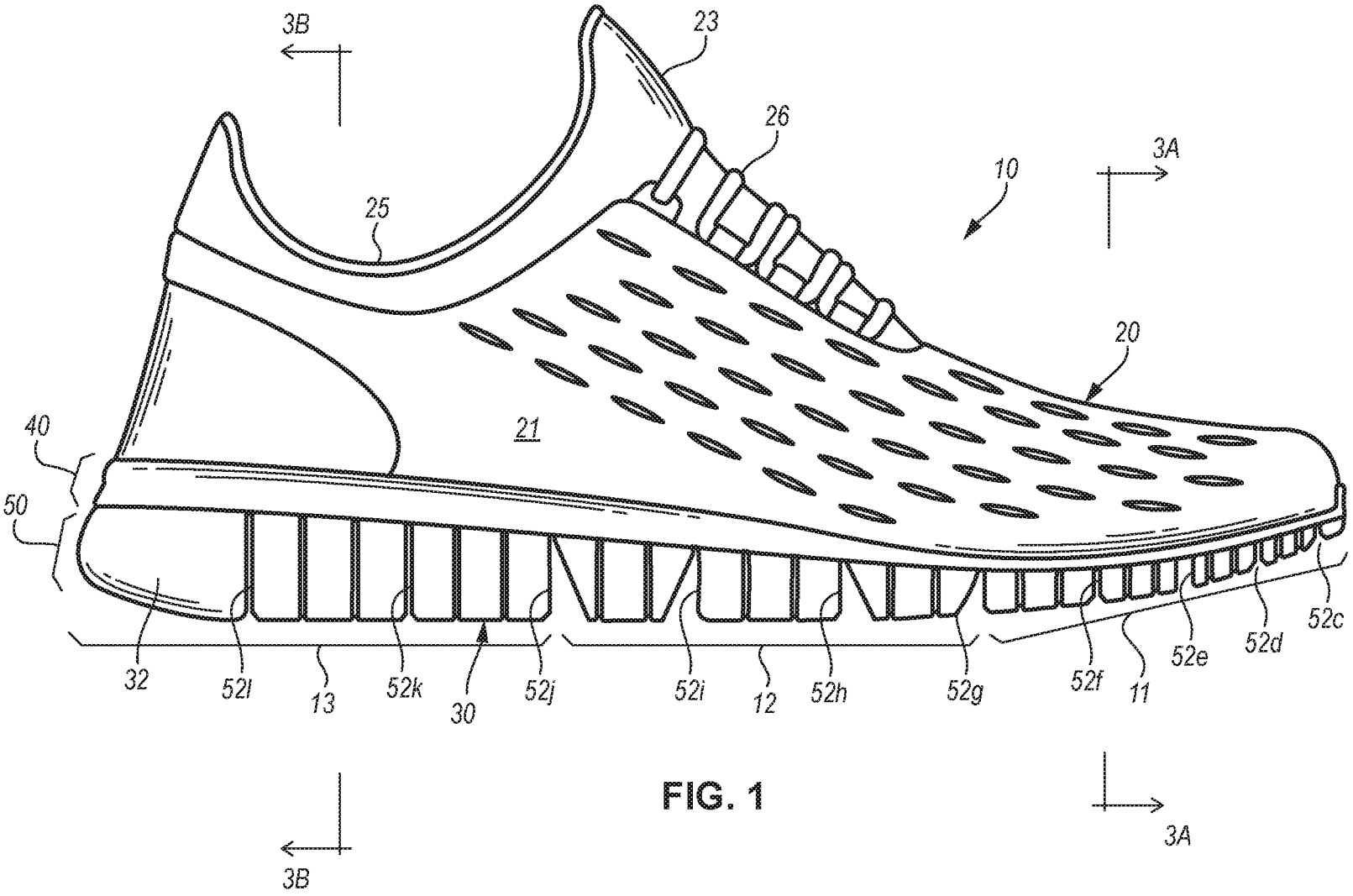
FIG. 1 is a schematic side view of the lateral side of an article of footwear.
Figure 2:
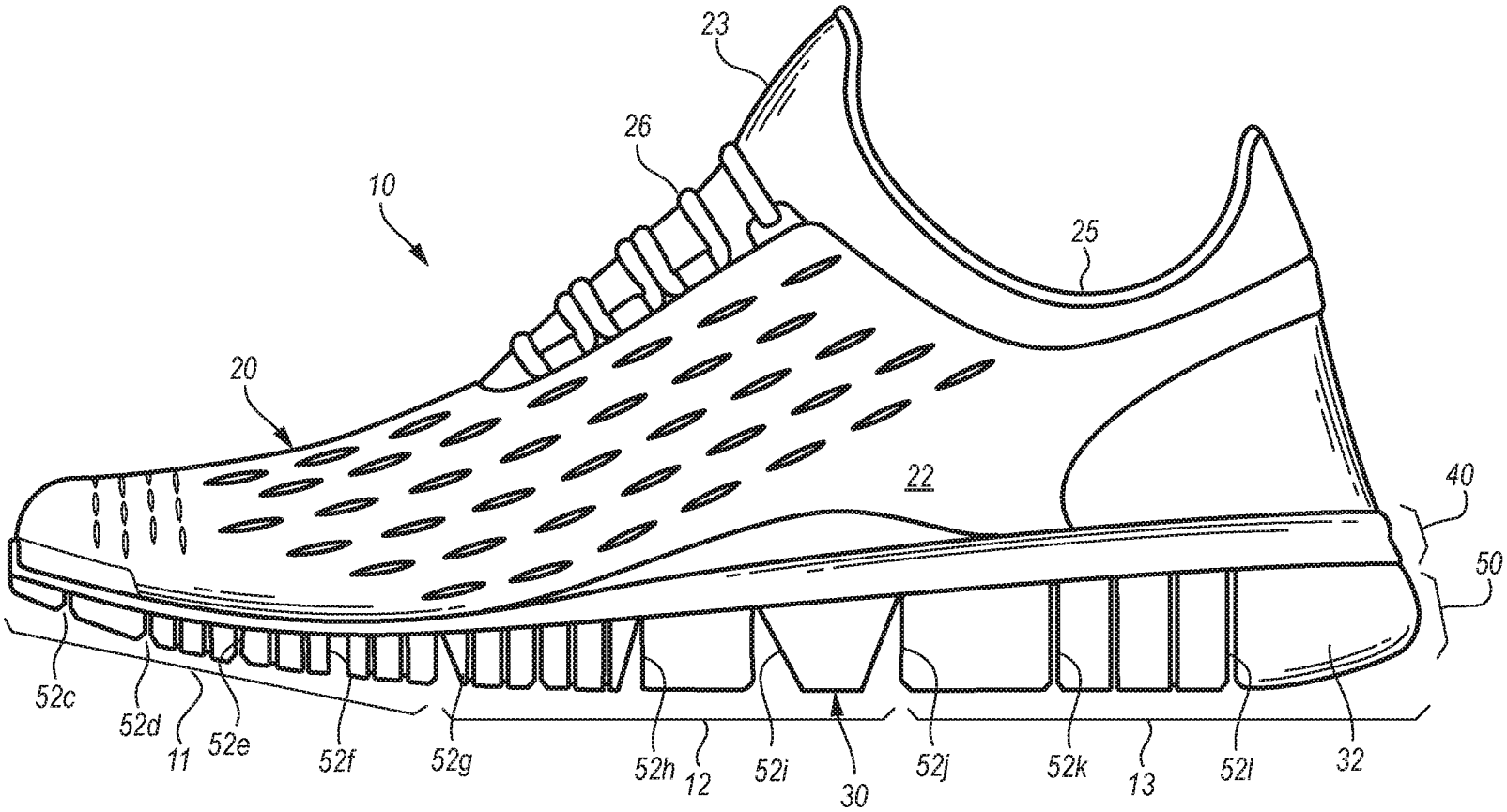
FIG. 2 is a schematic side view of the medial side of an article of footwear.

For purposes of reference, footwear 10 may be divided into three general regions: a forefoot region 11, a midfoot region 12, and a heel region 13, as defined in FIGS. 1 and 2. Regions 11-13 are not intended to demarcate precise areas of footwear 10. Rather, regions 11-13 are intended to represent general areas of footwear 10 that provide a frame of reference during the following discussion. Although regions 11-13 apply generally to footwear 10, references to regions 11-13 may also apply specifically to upper 20, sole structure 30, or an individual component or portion within either of upper 20 or sole structure 30.

The various material elements forming upper 20, which will be described in greater detail below, combine to provide a structure having a lateral side 21, an opposite medial side 22, a tongue 23, and a lasting sock 24 that form the void within upper 20. Lateral side 21 extends through each of regions 11-13 and is generally configured to contact and cover a lateral surface of the foot. A portion of lateral side 21 extends over an instep of the foot and overlaps a lateral side of tongue 23. Medial side 22 has a similar configuration that generally corresponds with a medial surface of the foot. A portion of medial side 22 also extends over the instep of the foot and overlaps an opposite medial side of tongue 23. In addition, lateral side 21, medial side 22, and tongue 23 cooperatively form an ankle opening 25 in heel region 13 to provide the foot with access to the void within upper 20.

Tongue 23 extends longitudinally along upper 20 and is positioned to contact the instep area of the foot. Side portions of tongue 23 are secured to an interior surface of each of lateral side 21 and medial side 22. A lace 26 extends over tongue 23 and through apertures formed in lateral side 21 and medial side 22. Tongue 23 extends under lace 26 to separate lace 26 from the instep area of the foot. By increasing the tension in lace 26, the tension in lateral side 21 and medial side 22 may be increased so as to draw lateral side 21 and medial side 22 into contact with the foot. Similarly, by decreasing the tension in lace 26, the tension in lateral side 21 and medial side 22 may be decreased so as to provide additional volume for the foot within upper 20. This general configuration provides, therefore, a mechanism for adjusting the fit of upper 20 and accommodating various foot dimensions.

A variety of materials are suitable for upper 20, including the materials that are conventionally utilized in footwear uppers. Accordingly, upper 20 may be formed from combinations of leather, synthetic leather, natural or synthetic textiles, polymer sheets, polymer foams, mesh textiles, felts, non-woven polymers, or rubber materials, for example. The exposed portions of upper 20 are formed from two coextensive layers of material that are stitched or adhesively bonded together.

Figure 3B:
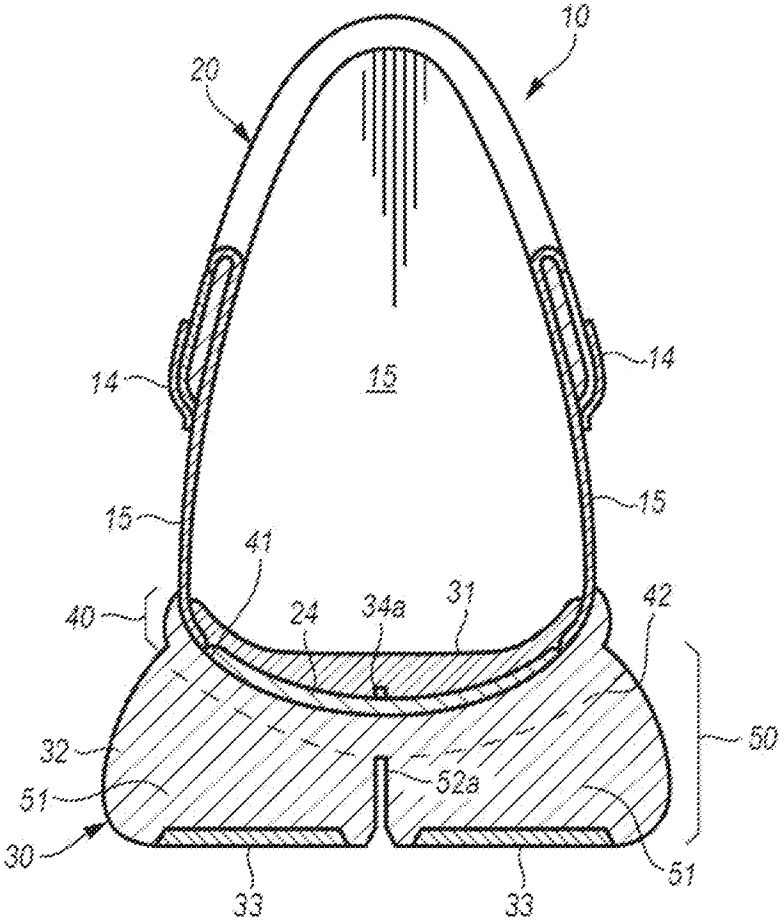
FIG. 3B is a schematic cross-sectional view of a portion of the article of footwear of FIG. 1, taken along line 3B-3B.
Figure 3A:
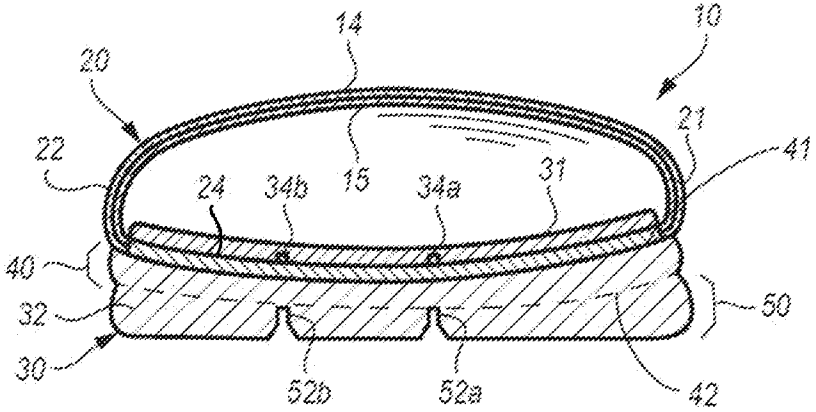
FIG. 3A is a schematic cross-sectional view of a portion of the article of footwear of FIG. 1, taken along line 3A-3A.

As more clearly shown in FIGS. 3A and 3B, the sole structure 30 may include an insole 31, a midsole 32, and an outsole 33. The insole 31 is positioned within upper 20 and adjacent to the upper surface of lasting sock 24 in order to contact the plantar (lower) surface of the foot and enhance the comfort of footwear 10. Midsole 32 is secured to a lower portion of upper 20, including lasting sock 24, and is positioned to extend under the foot during use. Among other purposes, midsole 32 attenuates ground reaction forces and absorbs energy (i.e., imparts cushioning) when walking or running, for example. Suitable materials for midsole 32 are any of the conventional polymer foams that are utilized in footwear midsoles, including ethylvinylacetate and polyurethane foam. Outsole 33 is secured to a lower surface of midsole 32 to provide wear-resistance, and outsole 33 may be recessed within midsole 32. Although outsole 33 may extend throughout the lower surface of midsole 32, outsole 33 is located within heel portion 13 in the particular embodiment depicted in the figures. Suitable materials for outsole 33 include any of the conventional rubber materials that are utilized in footwear outsoles, such as carbon black rubber compound.

Conventional footwear midsoles are generally unitary, polymer foam structures that extend throughout the length of the foot and may have a stiffness or inflexibility that inhibit the natural motion of the foot. Beyond this, most conventional sole designs reinforce the midfoot either through the use of additional/thicker materials, or through the use of inherently stiffer or more dense materials to provide added stability and arch support. In contrast with the conventional footwear midsole, midsole 32 has an articulated structure that imparts relatively high flexibility and articulation. The flexible structure of midsole 32 is configured to complement the natural motion of the foot during running or other activities, and may impart a feeling or sensation of barefoot running. Furthermore, the specific siping profile of sole may promote midfoot plantarflexion or short-footing. In contrast with simply running barefoot, however, midsole 32 attenuates ground reaction forces and absorbs energy to cushion the foot and decrease the overall stress upon the foot.

As shown in FIGS. 3A and 3B, the midsole 32 may generally be divided into an upper connecting portion 40 and a lower siped portion 50. The connecting portion 40 includes both an upper surface 41 and an opposite lower surface 42. The upper surface 41 is positioned adjacent to upper 20 and may be secured directly to upper 20, thereby providing support for the foot. The upper surface 41 may, therefore, be contoured to conform to the natural, anatomical shape of the foot. Accordingly, the upper surface 41 may form an arch support area in midfoot region 12, and peripheral areas of upper surface 41 may be generally cupped upward to provide a concavity for receiving and seating the foot. In other embodiments, upper surface 41 may instead have a non-contoured configuration.

The thickness of the connecting portion 40, which is defined as the dimension that extends between upper surface 41 and lower surface 42, may vary along the longitudinal length of midsole 32. The thickness is depicted graphically in FIG. 4 as thickness dimensions 43*a*-43*c*. Dimension 43*a*, defined in forefoot region 11, may be approximately 3 millimeters and may range from 1 to 5 millimeters, for example. Dimension 43*b*, defined in midfoot region 12, may be approximately 8 millimeters and may range from 1 to 11 millimeters, for example. Similarly, dimension 43*c*, defined in heel region 13, may be approximately 6 millimeters and may range from 1 to 10 millimeters, for example. The thickness of connecting portion 40 may, therefore, increase in directions that extend from forefoot region 11 and heel region 13 toward midfoot region 12. One skilled in the relevant art will recognize, however, that a variety of thickness dimensions and variations will be suitable for connecting portion 40.

Areas of the connecting portion 40 that exhibit a relatively thin thickness will, in general, possess more flexibility than areas of connecting portion 40 that exhibit a greater thickness. Variations in the thickness of connecting portion 40 may, therefore, be utilized to modify the flexibility of sole structure 30 in specific areas.

The siped portion 50 forms a plurality of individual, separate sole elements 51 that are separated by a plurality of sipes 52*a*-52*l*. The sole elements 51 are discrete portions of midsole 29 that extend downward from connecting portion 40. In addition, the sole elements 51 are secured to, and may be integral with the connecting portion 40. The shape of each sole element 51 is determined by the positions of the various sipes 52*a*-52*l*. As depicted in FIGS. 3A and 3B, sipes 52*a* and 52*b* extend in a longitudinal direction along sole structure 30, and sipes 52*c*-52*l* extend in a generally lateral direction (shown in FIG. 4). This positioning of the various sipes 52*a*-52*l* causes a majority of the sole elements 51 to exhibit a generally square, rectangular, or trapezoidal shape. The rearmost sole elements 51 may have a quarter-circular shape due to the curvature of sole structure 30 in the heel region 13.

The thickness of siped portion 50, which is defined as the dimension that extends between the lower surface 42 of the connecting portion 40 to a lower surface of the midsole 32, may vary along the longitudinal length of midsole 32. The thickness is depicted graphically in FIG. 4 as thickness dimensions 53*a* and 53*c*. Dimension 53*a*, defined in forefoot region 11, may be approximately 7 millimeters and may range from 3 to 12 millimeters, for example. Similarly, dimension 53*c*, defined in heel region 13, may be approximately 12 millimeters and may range from 8 to 20 millimeters, for example. The thickness of the siped portion 50 may, therefore, increase in a direction that extends from forefoot region 11 to heel region 13. One skilled in the relevant art will recognize, however, that a variety of thickness dimensions and variations will be suitable for the siped portion 50.

Figure 5:
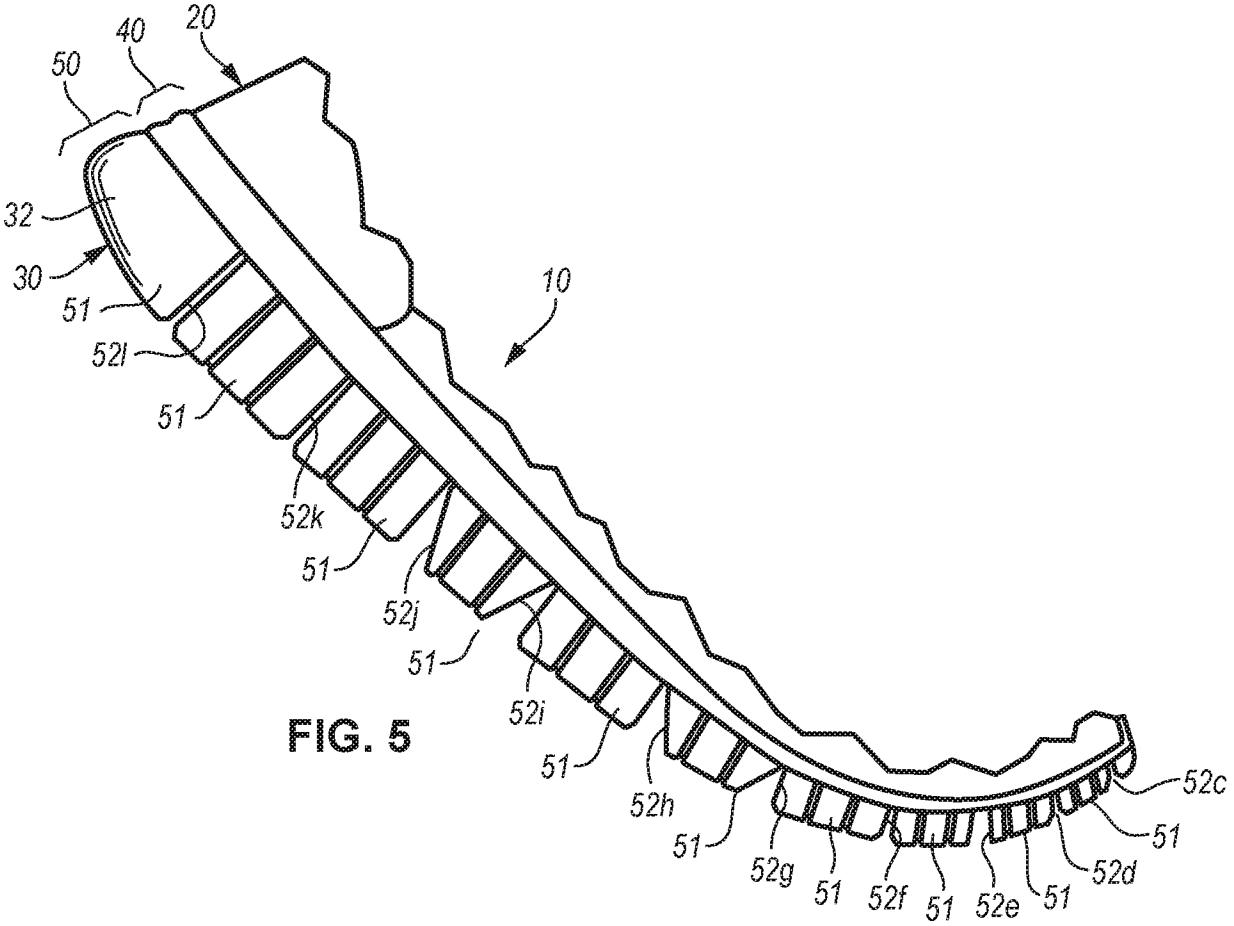
FIG. 5 is a schematic side view of an article of footwear in dorsiflexion.

The shape of each sole element 51, as discussed above, is determined by the positions of the various sipes 52*a*-52*l*, which are incisions or spaces that extend upward into midsole 32 and extend between the sole elements 51. The various sipes 52*a*-52*l* also increase the flexibility of sole structure 30 by forming an articulated configuration in midsole 32. Whereas the conventional footwear midsole is a unitary element of polymer foam, the sipes 52*a*-52*l* in the present design form flexion lines in the sole structure 30 and, therefore, have an effect upon the directions of flex in midsole 32. The manner in which the sole structure 30 may flex or articulate as a result of the sipes 52*a*-52*l* is graphically depicted in FIGS. 5-6.

Lateral flexibility of the sole structure 30 (i.e., flexibility in a direction that extends between a lateral side and a medial side) is provided by the longitudinal sipes 52*a* and 52*b*. In one configuration, a first longitudinal sipe 52*a* extends longitudinally through all three of regions 11-13. This sipe 52*a* may have a straight or linear configuration. In forefoot region 11 and midfoot region 12, the sipe 52*a* is spaced inward from the lateral side of sole structure 30, and the sipe 52*a* may be centrally-located in heel region 13. A second longitudinal sipe 52*b* may be only located in forefoot region 11 and a portion of midfoot region 12. In some configurations, it may be centrally-located and may extend in a direction that is generally parallel to the first longitudinal sipe 52*a*. In general, the depth of sipes 52*a* and 52*b* increase as the sipes 52*a* and 52*b* extend from the forefoot region 11 to the heel region 13.

Longitudinal flexibility of the sole structure 30 (i.e., flexibility in a direction that extends between regions 11 and 13) is provided by the various lateral sipes 52*c*-52*l*. As shown, lateral sipes 52*c*-52*f* are positioned in forefoot region 11, lateral sipe 52*g* generally extends along the interface between the forefoot region 11 and the midfoot region 12, sipes 52*h* and 52*i* are positioned in the midfoot region 12, sipe 52*j* generally extends along the interface between the midfoot region 12 and the heel region 13, and sipes 52*k* and 52*l* are positioned in the heel region 13.

The positions and orientations of sipes 52*a*-52*l* are selected to complement the natural motion of the foot during the running cycle. In general, the motion of the foot during running proceeds as follows: Initially, the heel strikes the ground, followed by the ball of the foot. As the heel leaves the ground, the foot rolls forward so that the toes make contact, and finally the entire foot leaves the ground to begin another cycle. During the time that the foot is in contact with the ground, the foot typically rolls from the outside or lateral side to the inside or medial side, a process called pronation. That is, normally, the outside of the heel strikes first and the toes on the inside of the foot leave the ground last. Lateral sipes 52*c*-52*l* ensure that the foot remains in a neutral foot-strike position and complement the neutral forward roll of the foot as it is in contact with the ground. Longitudinal sipes 52*a* and 52*b* provide lateral flexibility in order to permit the foot to pronate naturally during the running cycle. Similarly, the angled configuration of sipes 52*c*-52*h*, as discussed above, provides additional flexibility that further enhances the natural, motion of the foot.

Figure 4:
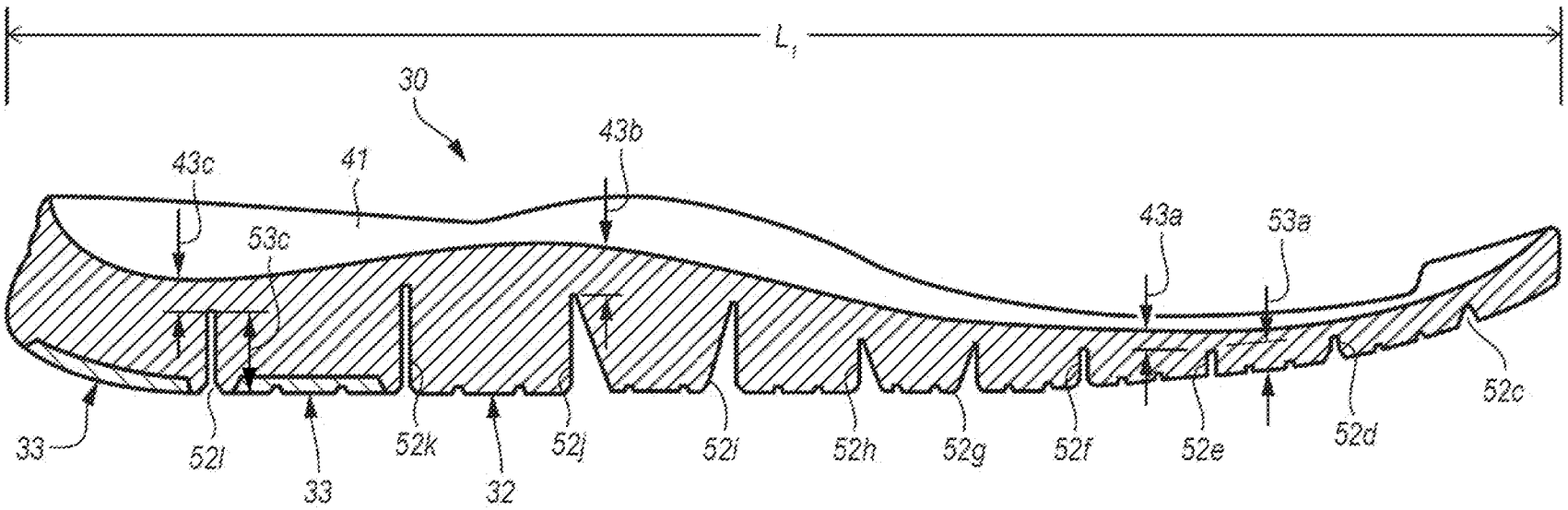
FIG. 4 is a schematic cross-sectional view of an article of footwear, taken parallel to a longitudinal axis that extends between a forefoot region and a heel region.

With continued reference to FIG. 4, in some embodiments, one or more of the lateral sipes 52*g*-52*j* within the midfoot region 12 may be particularly designed and/or sized to permit plantarflexion specifically within the midfoot region 12. This motion may permit the wearer's toes and heel to draw closer to each other in a motion called short-footing.

To permit this downward flexion, in one configuration, a portion of one or more sole elements 51 may be removed or otherwise indented such that the sole element provides minimal or no resistance to the short-footing motion. For example, in one configuration, such as shown in FIGS. 1, 2, and 4, one or more of the lateral sipes 52*g*-52*j* within the midfoot region 12 may be formed with a prism/wedge shape (i.e., it may have a substantially triangular cross-sectional profile when cut along a longitudinal axis of the shoe). In one configuration, one or more of the prism shapes may have a right-triangle cross-sectional profile, while in other configurations one or more of the prism shapes may have a generally isosceles or equilateral triangle shape. In still other configurations, one or more of the sipes 52*g*-52*j* may have a generally trapezoidal or rectangular cross-sectional profile. As further illustrated in FIG. 4, the cross-sectional profile of one or more of the lateral sipes 52*g*-52*j* within the midfoot region 12 may provide the respective sipe with a width, measured in a longitudinal dimension at the ground-contacting surface that is greater than a similar longitudinal width, measured at the ground contacting surface, of the lateral sipes in the forefoot 52*a*-52*f* and the lateral sipes in the heel region 52*k*-52*l*.

Figure 6:
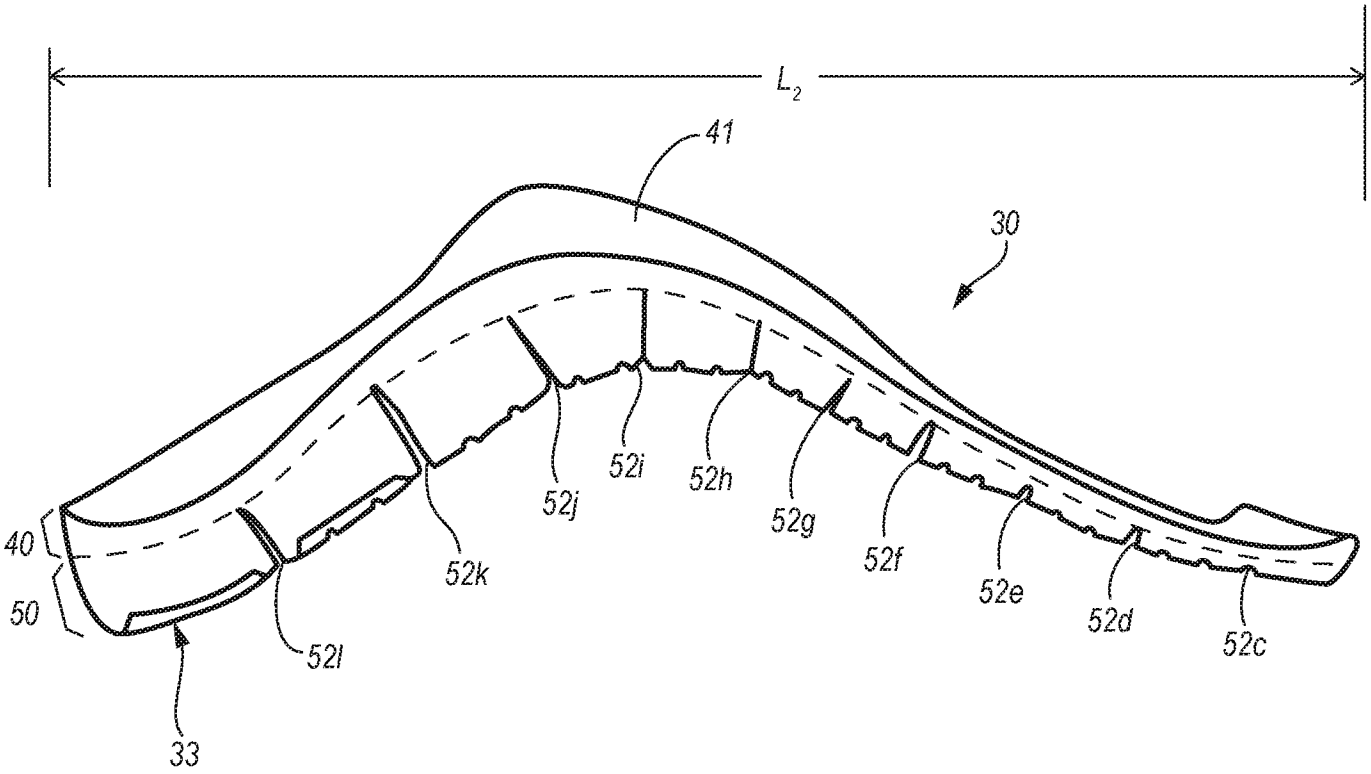
FIG. 6 is a schematic side view of an article of footwear with plantarflexion in a midfoot region.

In some embodiments, the short-footing sipes (e.g., sipes 52*g*-52*j*) may extend entirely across the shoe in a substantially lateral direction from the medial side to the lateral side of the midsole 32. In another embodiment, instead of cutting/forming large openings in the sole, one or more of the sole elements, or portions of the sole elements may be formed from a foam material that is more compliant/elastic than the material used to form the majority of the midsole. Said another way, the midsole 32 may be formed from a first foamed material that has a first hardness, and the midfoot region 12 may include laterally oriented strips of a second material, which are recessed into the midsole, and that have a second hardness that is less than the first hardness. In this manner, the comparatively softer material strips may permit the sole structure to more readily articulate to permit plantarflexion, such as generally illustrated in FIG. 6.

In some embodiments, the sole may be capable of a reduction in overall length (i.e., from length $L_1$ shown in FIG. 4 to shortened length $L_2$, shown in FIG. 6) by about 3% to about 18%, or by about 5% to about 15%, or even by about 8% to about 12%. These reductions in length assume negligible compression of the sole elements 51 themselves, and are measured from the rear most point of the heel region 13 to the forward-most point of the forefoot region 11.

Outsole 33 includes a plurality of outsole elements that are secured to a lower surface of selected sole elements 51, and an indentation is formed in the lower surface of the selected sole elements 51 to receive the outsole elements. As depicted in the figures, outsole 33 is limited to heel region 13. In some embodiments, however, each sole element 51 may be associated with an outsole element, or outsole 33 may extend throughout the lower surface of midsole 32.

A plurality of manufacturing methods are suitable for forming midsole 32. For example, midsole 32 may be formed as a unitary element, with sipes 52*a*-52*l* being subsequently formed through an incision process. Midsole 32 may also be molded such that one or more of the sipes 52*a*-52*l* are formed during the molding process. Suitable molding methods for midsole 32 include injection molding, pouring, or compression molding, for example. In each of the molding methods, a blown polymer resin is placed within a mold having the general shape and configuration of midsole 32.

In one configuration, at least one or more of the prism-shaped sipes or channels in the midfoot region 12 may be in-molded such as using a blade or wedge extending into the molding cavity from a side wall. During the molding process, polymer resin is placed within the mold such that it eventually surrounds at least a portion of the protruding wedge. Upon setting, midsole 32 is removed from the mold, with the in molded sipes being formed during the molding process. Following this, one or more additional sipes may be cut, such as via a hot knife or other such siping process. To provide a suitable amount of plantarflexion, each in-molded midfoot sipe may have a width of from about 3 mm to about 8 mm, measured at the ground-contacting surface of the sole.

In some embodiments, the upper 20 and sole structure 30 have a structure that cooperatively flex, stretch, or otherwise move to provide an individual with a sensation of natural, barefoot running. That is, upper 20 and sole structure 30 are configured to complement the natural motion of the foot during running or other activities. As discussed above, midsole 32 includes a plurality of sipes 52*a*-52*l* that enhance the flex properties of sole structure 30. The positions, orientations, and depths of sipes 52*a*-52*l* are selected to provide specific degrees of flexibility in selected areas and directions. That is, sipes 52*a*-52*l* may be utilized to provide the individual with a sensation of natural, barefoot running. In contrast with barefoot running, however, sole structure 30 attenuates ground reaction forces and absorbs energy to cushion the foot and decrease the overall stress upon the foot.

The above features and advantages, and other features and advantages, of the present teachings are readily apparent from the following detailed description of some of the best modes and other embodiments for carrying out the present teachings, as defined in the appended claims, when taken in connection with the accompanying drawings.

The invention claimed is:

1. A sole structure for an article of footwear having an upper adapted to receive a foot and defining a heel region, a midfoot region, and a forefoot region, and further defining a medial side and a lateral side, the sole structure being particularly configured to transition between a relaxed state and a plantarflexed state, the sole structure comprising:

a connecting portion coupled to a siped portion, the connecting portion comprising an upper surface and an opposite ground-facing side, and the siped portion comprising an upper side and an opposite ground-contacting surface;

wherein:

the connecting portion extends across the sole structure and the upper surface is operative to be secured to the upper;

the siped portion extends from the ground-facing side of the connecting portion and includes a plurality of sole elements, each of the plurality of sole elements being at least partially defined by one or more of a plurality of sipes that extend from the ground-contacting surface to the ground-facing side of the connecting portion, the plurality of sipes including:

a first lateral sipe located within the forefoot region and extending from the medial side to the lateral side of the sole structure, the first lateral sipe having a first width, measured at the ground-contacting surface in a longitudinal direction of the sole structure while the sole structure is in the relaxed state;

a second, in-molded, lateral sipe located within the midfoot region and extending from the medial side to the lateral side of the sole structure, the second, in-molded, lateral sipe having a second width, measured at the ground-contacting surface in the longitudinal direction of the sole structure while the sole structure is in the relaxed state; and a third lateral sipe located within the heel region and extending from the medial side to the lateral side of the sole structure, the third lateral sipe having a third width, measured at the ground-contacting surface in the longitudinal direction of the sole structure while the sole structure is in the relaxed state;

wherein the second width is greater than the first width and wherein the second width is greater than the third width;

the second, in-molded lateral sipe being sized to permit plantarflexion of the sole structure without deformation of an adjacent sole element;

wherein the second, in-molded, lateral sipe defines a triangular-shaped void extending between adjacent ones of the plurality of sole elements when viewed along the longitudinal direction and such that, upon bending into the plantarflexed state due to plantarflexion, a majority of a forward surface of the second in-molded lateral sipe makes flush contact with a majority of a rear surface of the second in-molded lateral sipe prior to compression of material of adjacent ones of the plurality of sole elements; and wherein the second, in-molded, lateral sipe defines a right triangular-shaped void extending between adjacent ones of the plurality of sole elements when viewed from a medial side perspective or a lateral side perspective.

2. The sole structure of claim 1, wherein the sole structure has a first undeformed longitudinal length, and achieves a second, deformed longitudinal length during plantarflexion, and wherein the second, deformed longitudinal length is 3% to 18% shorter than the first undeformed longitudinal length.

3. The sole structure of claim 1, wherein the connecting portion has a transverse thickness measured between the upper surface and the ground facing side, and wherein the transverse thickness varies from the heel region to the forefoot region.

4. The sole structure of claim 3, wherein the transverse thickness of the connecting portion is between 1 mm and 5 mm in the forefoot region, between 1 mm and 11 mm in the midfoot region, and between 1 mm and 10 mm in the heel region.

5. The sole structure of claim 4, wherein the transverse thickness of the connecting portion is greater in the heel region than in the forefoot region.

6. The sole structure of claim 5, wherein the transverse thickness of the connecting portion is greater in the midfoot region than in either the heel region or the forefoot region.

7. The sole structure of claim 1, wherein the siped portion has a transverse thickness measured between the upper side and the ground-contacting surface, and wherein the transverse thickness varies from the heel region to the forefoot region.

8. The sole structure of claim 7, wherein the transverse thickness of the siped portion is between 3 mm and 12 mm in the forefoot region, and between 8 mm and 20 mm in the heel region.

9. The sole structure of claim 1, wherein the plurality of sipes that extend from the ground-contacting surface to the ground-facing side of the connecting portion includes at least one longitudinal sipe extending through each of the forefoot region, the midfoot region, and the heel region.

10. The sole structure of claim 9, further comprising a second longitudinal sipe extending only through the forefoot region and the midfoot region.

11. The sole structure of claim 1, wherein the connecting portion and the siped portion are integral with each other and formed from a common foamed polymeric material.

12. The sole structure of claim 1, wherein the plantarflexion is defined by a concave curvature of the ground contacting surface.

13. The sole structure of claim 1, wherein the width, measured at the ground-contacting surface in the longitudinal direction of the sole structure, of the second, in-molded, lateral sipe is between 3 mm and 8 mm.

* * * * *